United States Patent [19]

Sato et al.

[11] 3,970,043

[45] July 20, 1976

[54] ELECTROPHOTOGRAPHIC DEVICE FOR LIQUID DEVELOPMENT

[75] Inventors: Masamichi Sato; Shigeru Tezuka, both of Tokyo, Japan

[73] Assignee: Xerox Corporation, Stamford, Conn.

[22] Filed: Oct. 7, 1974

[21] Appl. No.: 512,382

Related U.S. Application Data

[62] Division of Ser. No. 370,908, June 18, 1973, Pat. No. 3,870,514.

[52] U.S. Cl. ..... 118/637; 118/DIG. 23; 427/15

[51] Int. Cl.[2] ..... G03G 13/10

[58] Field of Search ..... 118/637, 638, DIG. 23; 117/37 LE; 355/10; 96/1, 64

[56] References Cited

UNITED STATES PATENTS

| | | | |
|---|---|---|---|
| 3,328,193 | 6/1967 | Oliphant et al. | 117/37 LE |
| 3,707,943 | 1/1973 | Matsumoto et al. | 118/637 |
| 3,774,574 | 11/1973 | Sato et al. | 118/637 |
| 3,779,206 | 12/1973 | Sato et al. | 118/DIG. 23 |
| 3,816,114 | 6/1974 | Fukushima et al. | 118/637 X |
| 3,854,977 | 12/1974 | Fukushima | 118/DIG. 23 |

*Primary Examiner*—Louis K. Rimrodt

[57] ABSTRACT

A device in a liquid development system to prevent soiling of support rollers for an imaging member wherein the support rollers previously soiled the back surface of the imaging member. The invention comprises insulating the support rollers and applying a developing voltage only when the imaging member has been inserted between the support rollers and another set of rollers which also serve as development electrodes so that voltage is not applied on a given roller pair not carrying the imaging member, thus developer material is not induced to flow on roller pairs not bearing the imaging member.

4 Claims, 8 Drawing Figures

ELECTROPHOTOGRAPHIC DEVICE FOR LIQUID DEVELOPMENT

This application is a division of application Ser. No. 370,908, filed June 18, 1973, now U.S. Pat. No. 3,870,514, which issued March 11, 1975.

BACKGROUND OF THE INVENTION

This invention relates to electrostatic printing, and in particular, to a novel electrostatic printing device as well as a novel method of utilizing such a device in the production of an electrostatic latent image.

There have been developed various electrophotographic devices in which an electrostatic latent image is formed corresponding to the visual image of an object which has been projected onto a photoconductive plate. The resulting electrostatic latent image is thereafter developed into a visual image by deposition of powder in a pattern conforming to the electrostatic latent image. Such prior art devices are described in U.S. Pat. Nos. 2,221,776, 2,277,013 and 2,297,691 among others. Each of the aforesaid devices provides a means for first producing an electrostatic latent image into a visual reproduction in a subsequent operation.

While electrophotography is best known as a dry process, considerable effort has been expended on liquid development devices and processes for electrostatic latent images. The advantages thought to be obtainable with liquids include higher speed, greater uniformity, higher resolution, greater ease in handling the developer and self fixing. An early electrophotographic use of liquid developers is disclosed in U.S. Pat. No. 2,551,582 in which a solvent mist is presented to the electrostatic latent image where it is attracted selectively to the charged areas. The solvent image formed in this way can then be transferred to dye transfer paper which in turn is run against a web carrying a soluble dye such as used, for example, in spirit duplicating. Perhaps the most common electrophotographic liquid developer is analogous to the usual powder development arrangement having a carrier fluid with a strong triboelectric effect on a particulate material suspended in the fluid. For example, a pigment is suspended in petroleum solvent and then flowed over the electrostatic latent image so that the pigment deposits out in the image areas by virtue of a triboelectric charge picked up through contact with the carrier liquid. This is disclosed, for example in U.S. Pat. No. 3,010,842. A third type of liquid development is electrolytic in nature and development is produced by metallic ions depositing out of the electrolyte in accordance with the image. An example of this is disclosed in U.S. Pat. No. 3,057,787.

Figure 1:
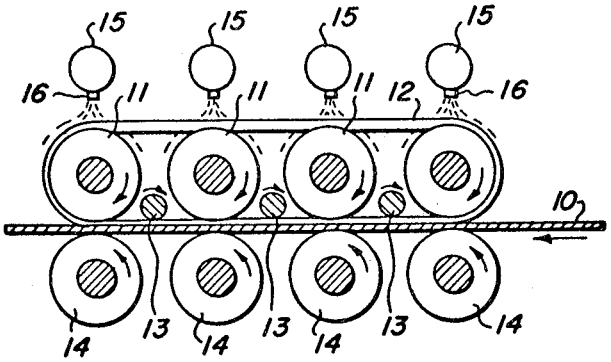
FIGS. 1 and 2 are respectively a side view and a front view of an electrophotographic development device having drawbacks.

In reference to FIG. 1, 10 designates an imaging member for electrophotography, 11 designates metal rollers serving as development electrodes, 12 designates a narrow endless belt mounted on the four rollers 11 and which is driven at equal speed with rollers 11, 13 designates rollers of small diameter which are weight-mounted on belt 12 between rollers 11 and rotated by friction against belt 12, 14 designates rollers, for example metal rollers, rotatable in contact and at equal speeds with belt 12. In practice, when rollers 14 are driven by motor through chains and gears, the rollers 11 and belt 12 and rollers 13 are driven by friction. The electrophotographic imaging member is held between belt 12 and rollers 14 and carried forward. 15 designates pipes for supplying liquid developer to rollers 11. The liquid developer is generally an insulating liquid in which fine toner particles are suspended. The liquid developer is retained in a supply container which is not shown. The liquid developer is suctioned up by a pump which is not shown and fed to pipes 15. It is then supplied to rollers 11 from nozzle or slit 16 on pipes 15. Belt 12 serves to equalize the speed of rotation of the four rollers 11 and also support small rollers 13. Belt 12 also maintains a small and constant space between the surface of the latent image and rollers 11 and rollers 13.

Figure 2:
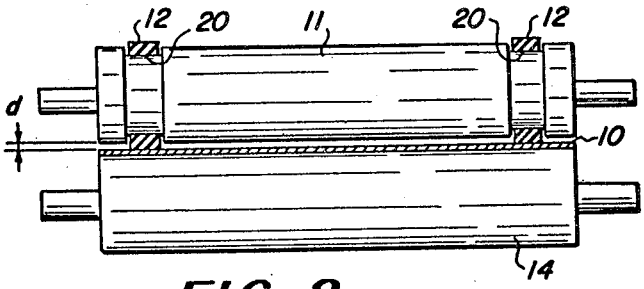

In FIG. 2, 20 designates grooves provided at the end of rollers 11 to which belt 12 is engaged. Mark *d* designates an interval between the latent image surface and rollers 11 defined relative to the thickness of belt 12 and the depth of the groove. Precise dimensions of belt 12 are provided, for example, 0.6mm in thickness, 5mm in width, and 16mm in circumference. In practice belt 12 is made for example of polyethylene polyamide or polyester polytetrafluoroethylene. The depth of groove 20 is 0.4mm and the width 7mm, for example, in the above-mentioned case. In this instance, space *d* was 0.2mm. The diameter of rollers 11 and 14 is 16mm and the diameter of the small rollers 13 is 4mm. The function of small rollers 13 is to provide the liquid developer uniformly on the latent image surface and to achieve the effect of a development electrode.

Although the device shown in FIGS. 1 and 2 provides very satisfactory results in positive development, a drawback has been noted in that rollers 14 when employed in reversal development become heavily stained and consequently the back surface of imaging member 10 becomes soiled.

Figure 3:
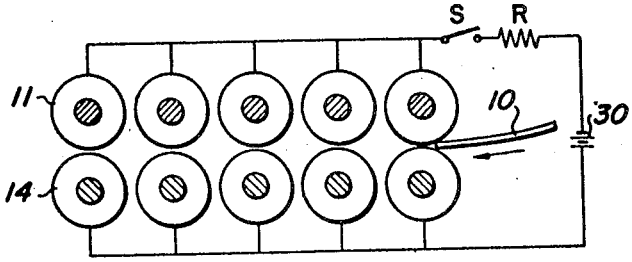
FIG. 3 is an electric circuit diagram of the device shown in FIGS. 1 and 2.

FIG. 3 shows an electric circuit used in reversal development employing the device as shown in FIGS. 1 and 2. In FIG. 3, 30 designates a bias power source which provides a D.C. current, for example, of 20–150 volts. The bias voltage is applied between rollers 11 and 14 through protective resistor R. Rollers 14 are electrically short-circuited through driving chains and gears. Rollers 11 are also electrically short-circuited through bearings. Rollers 11 and 14 are insulated from each other through endless belt 12. Directly before the leading end of imaging member 10 is inserted between the first pair of rollers, switch S is closed and a voltage is applied between rollers 11 and 14. Though imaging member 10 is present between the first pair of rollers upon initial insertion therebetween, it does not lie between the remaining three pairs of rollers. In the first roller pair the toner is applied electrostatically on the latent image surface of imaging member 10 so that roller 14 is not stained. When imaging member 10 advances between the remaining roller pairs and is present between all rollers no electrostatic action is applied on any roller 14. By further delivery of imaging member 10, there remains no portion of imaging member 10 between the first pair of rollers. Therefore, toner is applied on roller 14 of the fist roller pair. Thus, when imaging member 10 is present in any of the roller pairs, the roller where the imaging member is not present is stained. Consequently, the back surface of imaging member 10 which has been subsequently delivered is stained by contact with the stained roller. Therefore, a clean, white, back surface on imaging member 10 can not be obtained.

Thus, it is an object of the present invention to provide a novel electrophotographic liquid development device.

It is a further object of the present invention to provide a novel electrophotographic liquid development method.

Further objects and features of the invention will become apparent while reading the following description in connection with the drawings.

In accordance with the present invention, each roller pair is insulated and voltage is applied only when imaging member 10 is inserted between a given roller pair so that voltage is not applied on the roller pair having no imaging member present therebetween. In order to achieve this objective, there may be provided a microswitch for detecting the advance of the imaging member, or the voltage may be turned off according to a definite programme conforming to the size of the imaging member and the feeding speed thereof. However, the latter makes the device more complicated in structure.

Figure 4:
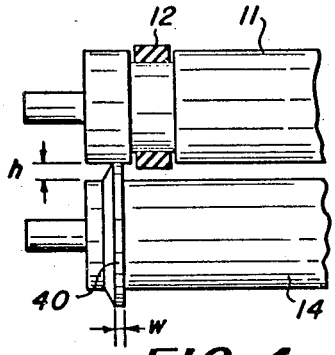
FIG. 4 is a view showing portions of an embodiment of the invention.

FIG. 4 is a view showing the essential portions of an embodiment of the invention. In FIG. 4, 40 designates flanges at both ends of roller 14. Flange 40 is generally made of metal and its height *h* is preferably a little larger than the height *d* shown in FIG. 5 in projection from groove 20 shown in FIG. 2. Desirably, height *h* may be 0.3–0.5mm when *d* is 0.2mm. The width W at the top of flange 40 may preferably be in the range of 0.1–1mm.

Figure 5:
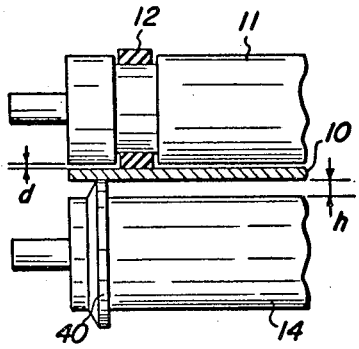
FIG. 5 is a view of the imaging member in the embodiment of FIG. 4.

FIG. 5 is a view showing the insertion of imaging member 10. If imaging member 10 is not present, flange 40 contacts with roller 11 and is electrically short-circuited. When imagining member 10 is inserted as shown in FIG. 5 flange 40 and roller 11 are insulated by imaging member 10. The position of flange 40 is preferably close to belt 12 and on the outside of belt 12. When imaging member 10 is inserted between flange 40 and roller 11 roller 11 is pushed upwardly.

Figure 6:
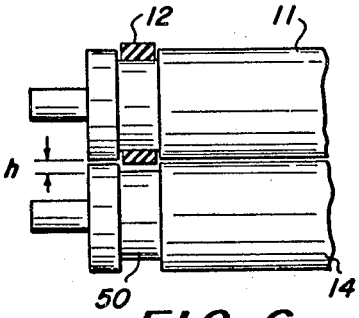
FIG. 6 is a view of portions of another embodiment.
Figure 7:
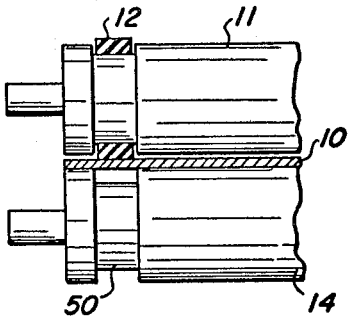
FIG. 7 is a view of the imaging member in the embodiment of FIG. 6.

FIG. 6 is a view of another embodiment corresponding to FIG. 4. FIG. 7 is a view showing the insertion of imaging member 10 in the device of FIG. 6. In FIG. 6, 50 designates a groove provided at the end of roller 14. Groove 50 faces groove 20 and is adapted to receive belt 12. The depth of groove 20 is designated by *h* and satisfies the requirement met by height *h* of the flange shown in FIG. 4. The width of groove 50 is preferably the same or a little larger than the width of groove 20. When imaging member 10 is not present, rollers 11 and 14 are in contact with each other. When imaging member 10 is inserted between rollers 11 and 14, rollers 11 and 14 are insulated by imaging member 10. The interval *d* between roller 11 and imaging member 10 is present in either of the embodiments.

Figure 8:
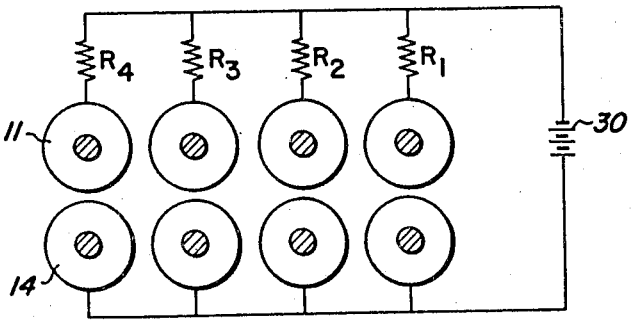
FIG. 8 is a view of the electrical circuit of the device of the invention.

FIG. 8 is a view of the electric circuit in the device of this invention. As can be seen, each roller pair is insulated from the other. By predetermining the value of resistance $R_1$–$R_4$, the voltage applied in each roller pair may be controlled. The practical value of the resistances $R_1$–$R_4$ is generally in the range of $10^3$–$10^5$ ohms.

In accordance with the present invention the rollers are rarely stained. Therefore, the back surface of imaging member 10 is generally free of stains. In addition, the device defined in accordance with the invention is efficient in reversal development but may also be used in positive development. Further, the presence of roller 13 is preferably desired but it is not essential to meet the requirements of the present invention.

Any suitable liquid developer composition may be employed with this invention. Typically, a dispersion of electroscopic particles is formed in a suitable liquid for example as by stirring or otherwise as is well known to those skilled in the art. Suitable electroscopic particles include any pigment or similar material having a fine particle size and being insoluble in the suspending liquid. In general the finer the powder the better the grain in the developed image. It is preferred that the average particle size be no larger than about 20 microns and for high quality work it is preferred that the average particle size be not more than about 5 microns. Suitable materials readily available in the desired size range includes charcoal, magnesium oxide, lithopone, cadmium yellow, chrome yellow, cobalt blue, sulfur, vermilion, barium yellow, cadmium red, ochre, burnt umber, cobalt green, burnt sienna, ultramarine blue, Hansa yellow, rose bengale, Dupont Luxol blue, and methyl cellulose. As already mentioned the pigment should not be soluble in the liquid and it must also be so selected relative to the liquid used as to assume a charge of the desired polarity. The electrostatic charge imparted to suspended particles is a function both of the nature of the particles and of the suspending liquid.

The liquid used must have a relatively high insulating value to avoid discharge of the electrostatic latent image. Suitable liquids include hydrocarbons such as benzene, xylene, hexane, naphtha, kerosene, etc.; halogenated hydrocarbons such as carbon tetrachloride, trichloroethylene, chloroform, Genetrons (a trade name of Allied Chemical Co. for various fluorinated compounds), Freons (a trade name of E. I. du Pont de Nemours & Co. for various fluorinated compounds), etc.: miscellaneous liquids such as turpentine, etc.

Any method known to those skilled in the art may be used for dispersing the pigment in the liquid. In general simple stirring or agitation of the liquid is sufficient. Where a highly uniform and stable suspension is desired, the suspension formed by stirring may be passed through a colloid mill, but excellent suspensions may be attained without such treatment. Suspending agents may be used where they do not impair the insulating properties of the liquid.

The density of pigment deposited on the electrostatographic plate is dependent on the charge of the electrostatic latent image, the pigment concentration in the liquid and the pressure of a development electrode. The function of the development electrode is to draw the lines of force of the electrostatic image externally above the image-bearing surface. This gives improved solid-area coverage and by increasing the amount of the lines of force that are external to the image-bearing surface and hence available to attract electrostatically charged marking particles, improves the overall efficiency of the development process.

The developed images are satisfactory for visual inspection on the plate while still wet. If desired, the wet image may be transferred by absorption by paper. If desired, the image may be dried and transferred to a desired base such as paper. plastic etc. by the usual methods of electrostatic transfer as described in U.S. Pat. No. 2,576,047 to R. M. Schaffert or adhesive transfer as described in U.S. Pat. No. 2,661,289 to Mayo and Wolfe. The imaage, in turn, may then be fixed by any means known to those skilled in the art such as those described, for example, in U.S. Pat. No. 2,297,691 to C. F. Carlson. Thus where either the pigment itself is fusible by heat or solvent vapor, or where the sheet to which it is transferred is coated or impregnated with a material fusible by heat or solvent vapor, then the use of either heat or solvent vapor will permanently affix the image to the sheet. Alternatively, another method of fixing the image comprises spraying the surface of the sheet bearing the image with a fixative lacquer by atomizer. Other means of transferring and/or fixing the image known to those skilled in the art may be used.

As disclosed, the device when employed in a liquid development system prevents the soiling of support rollers for an imaging member wherein such support rollers in turn previously soiled the back surface of the imaging member. Thus, by insulating the support rollers and applying a developing voltage only when the imaging member has been inserted between the support rollers and another set of rollers which also serve as development electrodes so that voltage is not applied on a given pair of support and development electrodes rollers not bearing the imaging member, developer material is not induced to flow on the support rollers as to soil them.

What is claimed is:

1. An electrophotographic device for liquid development of an imaging member comprising support rollers for said imaging member, development electrode rollers positioned opposite the image bearing surface of said imaging member, said development electrode rollers having an endless belt mounted thereon, said support rollers having grooves therein at each end thereof, said grooves facing and aligned with grooves in the development electrode rollers so that said support rollers are in physical contact with said development electrode rollers in the absence of said imaging member, driving means for said support rollers, means for supplying a voltage potential across said imaging member, and means for supplying liquid developer to said imaging member.

2. An electrophotographic device for liquid development of an imaging member comprising support rollers for said imaging member, development electrode rollers positioned opposite the image bearing surface of said imaging member, said development electrode rollers having an endless belt mounted thereon, said support rollers having grooves therein at each end thereof, said grooves facing and aligned with grooves in the development electrode rollers so that said support rollers are in physical contact with said development electrode rollers in the absence of said imaging member, driving means for said support rollers, means for supplying a voltage potential across said imaging member only when said imaging member has been inserted between said support rollers and said development electrode rollers so that no voltage is applied in the absence of said imaging member, and means for supplying liquid developer to said imaging member.

3. An electrophotographic device for liquid development of an imaging member comprising support rollers for said imaging member, development electrode rollers positioned opposite the image bearing surface of said imaging member, said development electrode rollers having an endless belt mounted thereon, said support rollers having upraised flanges at both ends thereof having a height between about 0.3 to about 0.5 mm and a width between about 0.1 to about 1 mm, said support rollers being in physical contact with said development electrode rollers in the absence of said imaging member and being electrically insulated from said development electrode rollers in the presence of said imaging member, driving means for said support rollers, means for supplying a voltage potential across said imaging member, and means for supplying liquid developer to said imaging member.

4. An electrophotographic device for liquid development of an imaging member comprising support rollers for said imaging member, development electrode rollers positioned opposite the image bearing surface of said imaging member, said development electrode rollers having an endless belt mounted thereon, said support rollers have upraised flanges at both ends thereof of a height between about 0.3 to about 0.5 mm and a width between about 0.1 to about 1 mm, said support rollers being in physical contact with said development electrode rollers in the absence of said imaging member and being electrically insulated from said development electrode rollers in the presence of said imaging member, driving means for said support rollers, means for supplying a voltage potential across said imaging member only when said imaging member has been inserted between said support rollers and said development electrode rollers so that no voltage is applied in the absence of said imaging member, and means for supplying liquid developer to said imaging member.

* * * * *